United States Patent [19]

Baker

[11] 4,107,766

[45] Aug. 15, 1978

[54] EMERGENCY POWER FAILURE LIGHT

[75] Inventor: Fred E. Baker, Asheboro, N.C.

[73] Assignee: General Electric Company, Bridgeport, Conn.

[21] Appl. No.: 728,979

[22] Filed: Oct. 4, 1976

[51] Int. Cl.[2] ..... F21V 21/08; F21V 25/00

[52] U.S. Cl. ..... 362/226; 362/183; 362/196

[58] Field of Search ..... 240/52.1, 153, 10.6 R; 362/226, 196, 183

[56] References Cited

U.S. PATENT DOCUMENTS

| | | | |
|---|---|---|---|
| 2,818,498 | 12/1957 | Foch | 240/10.6 R |
| 3,222,513 | 12/1965 | Feo | 240/10.6 R |
| 3,233,091 | 2/1966 | Hunt | 240/10.6 R |
| 3,710,090 | 1/1973 | Shea | 240/153 |
| 3,813,641 | 5/1974 | Balchunas | 339/170 |
| 3,819,923 | 6/1974 | Schumacher | 240/52.1 |

*Primary Examiner*—Samuel W. Engle
*Assistant Examiner*—Donald P. Walsh

[57] ABSTRACT

The invention is directed to an emergency power failure light of a multi-piece assembled housing with a safety interlock and using a bottom cup-shaped member to support electrical components with the member having protruding male prongs out the back for plugging into an AC outlet. A mid-cover is sized to nest and completely cover in the bottom member. It is open at the top and has a bottom wall to cover the electrical components, the wall also being apertured for a bulb socket with an electrical contact at the bottom. A curved reflector is mounted over the bulb in the mid cover and is carried by a lens coverplate that latches over the reflector to completely cover the mid cover and the lens and notches into the mid cover with the coverplate having a threaded socket extending through the mid cover into the assembly. A single bolt means recesses in the back of the bottom member and secures the assembly together requiring it to be removed from the AC outlet, whether an extension cord or wall outlet, before the bolt can be detached for bulb changing.

5 Claims, 4 Drawing Figures

EMERGENCY POWER FAILURE LIGHT

BACKGROUND OF THE INVENTION

1. Field of the Invention

The invention herein pertains to an emergency power failure light that has a safety interlock system so the light must be removed from any AC outlet before any access whatever can be had to the interior of the light for the purpose of changing the bulb.

2. Background of the Invention

Emergency power failure lights to automatically operate off DC or on battery power on failure of the AC circuit are well known. Typically, they provide an internal circuit with a relay that activates if power fails to connect in a battery to operate the emergency light. Such devices on large fixed emergency light services, such as a shelf in a room, are generally heavy duty units and out of reach and not designed to be portable. In smaller hand-held lights, generally of the size of a small transistor radio, the device is designed to be removed from the AC outlet and used as a temporary flashlight operating on internal battery power. Because such a device inherently invites the user to open it in order to change the bulb when it burns out, it presents a safety problem not normal, for example, in plug-in timers, or other devices which are not intended to be opened by the user under any circumstances. Generally, emergency lights have been sealed from behind, as in timers, by a series of recessed bolts holding the casing together. While access to the interior then requires removal from a flat wall AC outlet, it would be possible to remove the bolts and open the device if the light were attached to an extension cord having only the periphery of the female socket as its connection point. Thus, there is a need for a simple power failure light with an interlock system preventing any access to an AC source when the casing is opened for changing the bulb and even to prevent access to the DC source although this is minor being no more than an ordinary flashlight circuit.

SUMMARY OF THE INVENTION

Briefly described, the invention is directed to an emergency power failure light that has a multi-piece assembled housing with a safety interlock system and comprises a bottom cup-shaped member to enclose and support the electrical components, the member having protruding male prongs on the back for plugging into an AC outlet. A mid cover is sized to nest in the bottom member and the cover is open at the top with a bottom wall to completely close over the electrical components. The bottom wall has an apertured bulb socket with electrical contacts at the bottom and side and a curved reflector is mounted over the bulb for focusing the light. Over this there is provided a lens-containing coverplate that may carry the reflector and latches into and completely covers the mid cover which is secured to and covers the cup member by internal fastening means behind the reflector to isolate the electrical components when the cover is removed. The coverplate has a single threaded socket on its underside extending through the mid cover and into the assembly and a single bolt extends through the back of the bottom member from a recess to secure the entire assembly together. The single bolt is preferably disposed within the periphery of a circle through the prongs. This ensures that the entire assembly must be removed from any AC outlet, whether wall or extension cord, before the single bolt can be detached to remove the coverplate for changing the bulb. Thus, the main object is to provide a power failure light with a safety interlock system that prevents access to the interior unless the device is removed from any AC source normally used.

DESCRIPTION OF THE PREFERRED EMBODIMENT

The invention is described in connection with a small hand-held emergency power failure light of the general size of a transistor radio that plugs into an AC wall outlet to activate on power failure.

Figure 1:
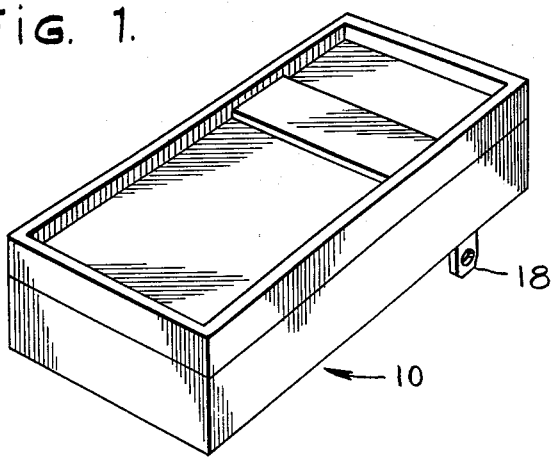
FIG. 1 is a perspective of a hand-held emergency light of the invention.
Figure 3:
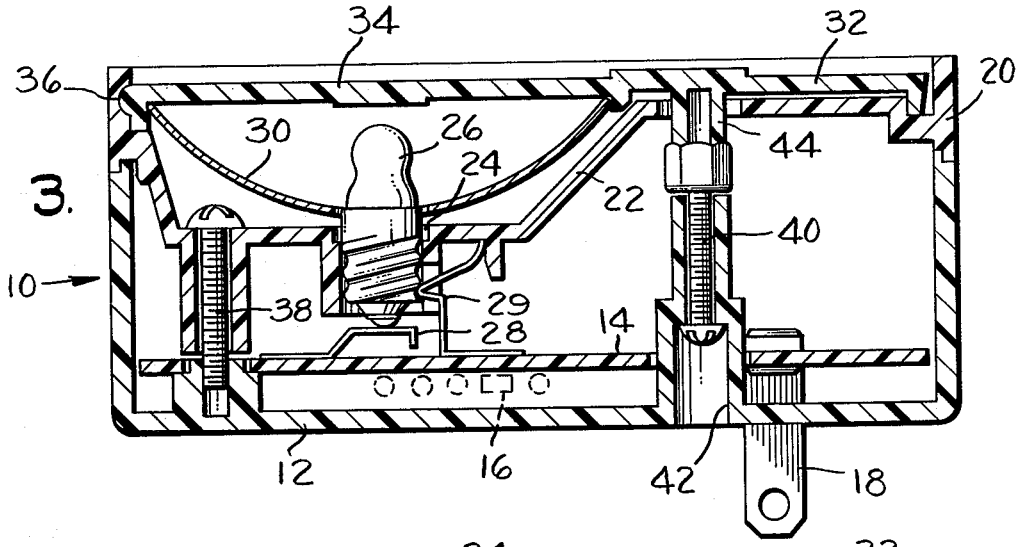
FIG. 3 is a cross-sectional view showing the assembled single bolt construction.
Figure 4:
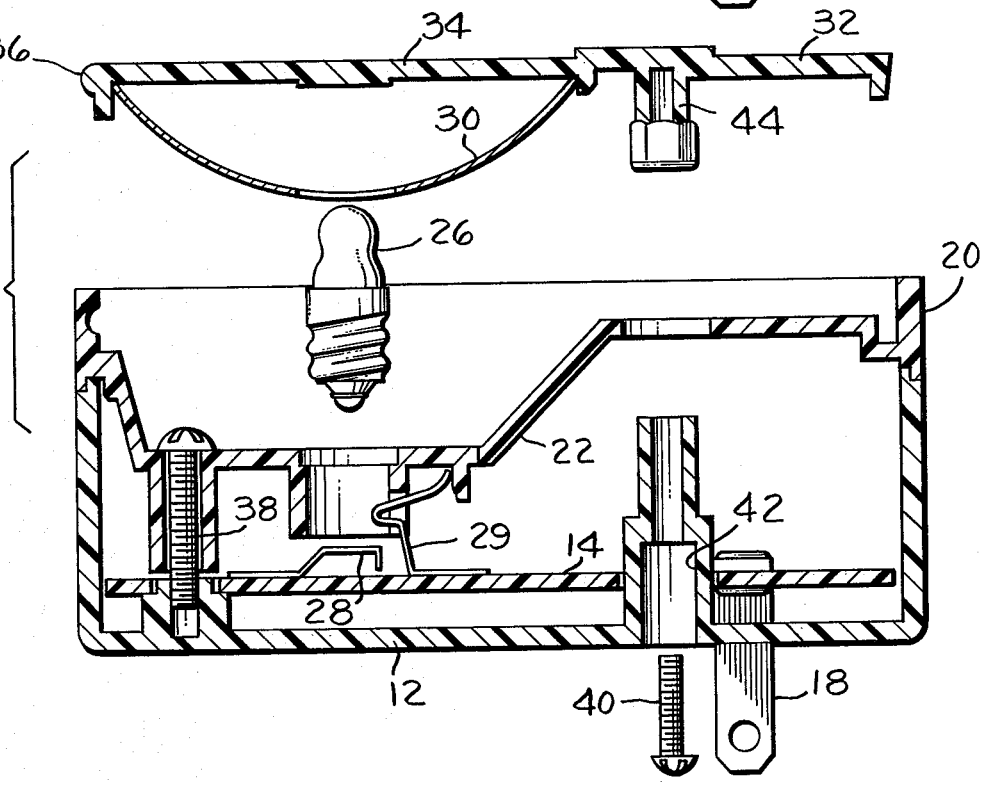
FIG. 4 is an exploded view of the device shown in FIG. 3.

Referring to FIG. 1, there is shown a perspective view of a typical transistor radio-sized emergency light that comprises a multi-piece assembled housing 10 of any suitable arrangement generally of plastic and having a safety interlock system. Referring to FIG. 3, the housing comprises a bottom cup-shaped member 12 that encloses and supports suitable electrical components therein generally mounted on a circuit board 14 with the main circuitry preferably being disposed on the bottom of the board as diagrammatically shown at 16. For connecting to an AC outlet, the usual male prongs 18 protrude from the back of member 12 so the whole device can be plugged into an outlet much as a normal well-known timer is mounted. For isolating the electrical components and providing bolt support, a suitably formed mid cover 20 is sized to fit with and preferably nest in and completely cover the bottom member 12 and the mid cover is open at the top with a bottom wall 22 designed to close over and isolate the electrical components. For the normal light bulb, the bottom wall is apertured at 24 and may be threaded so that bulb 26 may be screwed in to make electrical contact at 28 and 29 at the bottom and the side respectively or, as shown, the side contact may act as the thread and for operation on a conventional battery when the AC source is dead.

For focusing the light from bulb 26 there is provided a curved reflector 30 mounted over the bulb as shown. It is suitably apertured to fit over the bulb as any ordinary flashlight. Enclosing the entire upper open end of the light is a coverplate 32 containing a lens 34 that preferably latches and carries the reflector at 36, the coverplate nesting into and completely covering mid cover 20 in the overlapping arrangement shown in FIG. 3. Alternately, reflector 30 may attach to mid cover 20 but it could be fingermarked in bulb changing.

For securing the parts together, an internal screw fastening means 38 is disposed behind the reflector 30 and connects the mid cover 20 and cup member 12 and this fastening means is not accessible from outside the housing to substantially isolate the electrical components 16 when the coverplate 32 is removed for bulb changing. This prevents substantially any access to the major electrical components when the cover is off even though only minor DC voltage would be accessible.

Because this device is essentially a flashlight, the user is invited to open it for bulb changing. To prevent this happening when the device is connected to an AC source, the interlock system also comprises a single bolt means 40 that is suitably countersunk in a recess 42 in cup member 12 to mate with threaded socket 44 on the back side of coverplate 32 which extends through the mid cover into the assembly. Thus, single bolt 40 connects the entire assembled housing together and access to it is only from the back side of cup member 12 as will be apparent.

Figure 2:
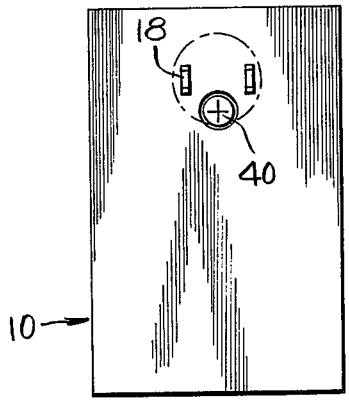
FIG. 2 is a back view of FIG. 1.

When the device is plugged into a flat wall outlet, there is no problem since access to single bolt 40 is obtained only by unplugging prongs 18 from the AC. However, in the event the device is plugged into an extension cord, it would be possible with a single bolt located elsewhere, to open the device when prongs 18 are alive. To avoid this, the assembled housing structure using the single bolt 40 is designed so that the bolt is disposed within the periphery of a circle through the prongs 18 as best seen dotted in FIG. 2. The dotted periphery of course represents an extension cord outlet which is the smallest AC outlet that could be reasonably used so that it will be apparent the device must be unplugged from the extension cord in order to gain access to bolt 40.

It will be apparent that the invention provides an emergency power failure light, that must be disconnected from the AC line whether it be an ordinary wall outlet or extension cord in order to change the bulb. The single bolt construction, with the bolt being located within the periphery of the AC prongs, effectively prevents any access to the interior of the light without disconnecting the unit from the wall or extension cord. This is necessary because the nature of the device invites the user to open it in order to change light bulbs. One opened, the internal electric components are effectively shielded by the mid cover wall so that any access, even by a screwdriver through aperture 24 to touch contacts 28 and 29, would result in only a minor twinge if indeed perceptible at all. It would be like one might obtain in a flashlight — harmless.

Thus, the device provides an emergency light with a safety interlock that prevents either a child or adult from coming into live AC contacts when changing the bulb.

While there has been described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. An emergency power failure light having a multipiece assembled housing with a safety interlock system comprising:

a bottom cup-shaped member enclosing and supporting the electrical components therein and having protruding male prongs on the back for plugging into an AC outlet;

a mid cover sized to fit completely over said bottom member and open at the top with a bottom wall to completely close over the electrical components;

said bottom wall having an apertured bulb socket therein with an electrical contact at the bottom thereof;

a curved reflector mounted over said bulb;

a lens-containing coverplate completely covering said mid cover;

said coverplate having a threaded socket therein extending through said mid cover, and single bolt means through the back of said bottom member securing the coverplate and mid cover thereto;

whereby the entire assembly must be removed from the AC outlet before the bolt means can be detached for coverplate removal for bulb changing.

2. Apparatus as described in claim 1 wherein said mid cover nests in said bottom member and the coverplate carries and latches over said reflector to extend into and completely cover said mid cover.

3. Apparatus as described in claim 2 wherein said mid cover is secured to said cup member by internal fastening means behind the reflector isolating said electrical components when said coverplate is removed.

4. Apparatus as described in claim 3 wherein said cup member is provided with a recess and said bolt means comprises a single bolt in said recess connecting the member and coverplate together.

5. Apparatus as described in claim 4 wherein said single bolt is disposed within the periphery of a circle through said prongs so the bolt lies within the smallest AC power outlet to which the light can be connected.

* * * * *